US005951449A

United States Patent [19]

Oppriecht

[11] Patent Number: 5,951,449

[45] Date of Patent: Sep. 14, 1999

[54] EXERCISE DEVICE

[76] Inventor: Clair E. Oppriecht, 2891 Bristol Rd., Rio, Wis. 53960

[21] Appl. No.: 09/041,259

[22] Filed: Mar. 12, 1998

[51] Int. Cl.[6] ..... A63B 21/062; A63B 21/008; A63B 22/02

[52] U.S. Cl. ..... 482/113; 482/54; 482/103; 482/112

[58] Field of Search ..... 482/94, 93, 98–103, 482/112, 113, 129, 133, 138, 908, 54

[56] References Cited

U.S. PATENT DOCUMENTS

| | | | |
|---|---|---|---|
| 177,251 | 5/1876 | Johnson . | |
| 767,008 | 8/1904 | Pelletier et al. . | |
| 3,174,343 | 3/1965 | Kasulis | 482/112 |
| 3,717,342 | 2/1973 | Haney et al. | 482/102 |
| 3,834,696 | 9/1974 | Spector . | |
| 4,772,016 | 9/1988 | Manion . | |
| 4,969,643 | 11/1990 | Kroeker et al. . | |
| 5,044,630 | 9/1991 | Ventimiglia | 482/112 |
| 5,147,263 | 9/1992 | Mueller . | |
| 5,372,564 | 12/1994 | Spirito . | |
| 5,466,204 | 11/1995 | Nearing | 482/102 |
| 5,558,190 | 9/1996 | Chang . | |
| 5,622,527 | 4/1997 | Watterson et al. . | |
| 5,653,666 | 8/1997 | Pantoleon . | |
| 5,685,810 | 11/1997 | Chung . | |

FOREIGN PATENT DOCUMENTS

| | | | |
|---|---|---|---|
| 86/06644 | 11/1986 | WIPO | 482/112 |

*Primary Examiner*—John Mulcahy
*Attorney, Agent, or Firm*—DeWitt Ross & Stevens S.C.

[57] ABSTRACT

Disclosed is an exercise device including a piston disposed within a cylinder having a first open end and a second end having a valve which independently controls air intake and exhaust through the second end of the cylinder, thereby controlling the air pressure exerted on the piston and hence the force required to raise the piston. A flexible connector is attached to the top of the piston, exits through the open end of the cylinder, and passes through a series of pulleys such that force exerted by the user on the opposite end of the connector is transmitted to the piston, whereby the piston slides within the cylinder.

20 Claims, 10 Drawing Sheets

EXERCISE DEVICE

FIELD OF THE INVENTION

The invention is directed to an exercise device which utilizes a free-floating piston disposed within a cylinder to provide smooth and continuously adjustable resistance to a user of the device.

DESCRIPTION OF THE PRIOR ART

It is generally accepted that the most time-effective physical exercise one can do is to perform aerobic and strength-training exercises simultaneously. Such exercises yield a synergistic effect in building cardiovascular health, muscular strength, and physical stamina at the same time. Two types of weight-bearing exercises are widely acknowledged to accomplish these goals: rowing and cross-country skiing. While several prior art devices effectively simulate the range of motion and resistance of rowing, prior art devices which attempt to simulate the range of motion and resistance of cross-country skiing have proven to have significant disadvantages. Commercially available exercise devices which simulate cross-country skiing generally fall into two categories. In the first category are machines which faithfully duplicate the independent upper body and lower body mechanics of cross-country skiing. Just as in cross-country skiing, these machines allow for independent action of the upper and lower body and for independent adjustable resistance between the two. However, these machines have two distinct disadvantages. First, like cross-country skiing, these machines require a high level of coordination and balance. As a result, few people are able to master fully the skills necessary to replicate the action and benefits of cross-country skiing. Second, the user's arms must move alternately back and forth. It would be advantageous to have a machine which allows the user's arms to move in unison to duplicate the "double-poling" action of cross-country skiing.

In the second category are exercise machines which employ reciprocating footbeds which slide back and forth in conjunction with adjustable-resistance levers that are pumped back and forth with the arms in opposition to the motion of the user's legs. That is, as the user's left leg moves forward, his left arm moves backward. This type of machine requires less skill to master, but does not provide an exercise which accurately simulates either the upper-body or lower-body mechanics of cross-country skiing. As a result, these devices fail to provide physical benefits comparable to those provided by cross-country skiing.

Numerous exercise machines which utilize pneumatic or hydraulic pistons to provide suitable resistance to a user of the machine are described in the patent literature. For example, two early patents, U.S. Pat. No. 177,251 to Johnson, issued May 9, 1876, and U.S. Pat. No. 767,008 to Pelletier et al., issued Aug. 9, 1904, illustrate devices in which sealed pneumatic cylinders (Johnson) or valved pneumatic cylinders (Pelletier et al.) are arranged to provide resistance to the user. Exercise machines of similar design which use hydraulic cylinders instead of pneumatic cylinders have also been described. See, for instance, U.S. Pat. No. 3,834,696 to Spector, issued Sep. 10, 1974.

More recently, the proven benefits of regular physical activity and the increased number of health and fitness clubs in the United States have spurred the development of a host of pneumatic and hydraulic exercise machines. Examples include U.S. Pat. No. 5,685,810 to Chung, issued Nov. 11, 1997. This patent describes a leg exercise device having two cooperating hydraulic pistons fastened to a rotating swing arm. After positioning one leg between two rollers attached to the swing arm, the user swings this leg back and forth through an arcing range of motion. The two cooperating pistons apply equal and adjustable resistance to the user's leg as it is swept in either direction throughout the range of motion.

U.S. Pat. No. 5,653,666 to Pantoleon, issued Aug. 5, 1997, describes a device in which a compressor-driven pneumatic piston is attached to a barbell or other type of weight whose range of motion is limited within a frame. When activated, the piston supplies downward pressure (i.e., negative pressure) on the barbell as the user lowers the weight for another repetition. This allows the user to increase the negative force exerted by the barbell during a weight-lifting exercise.

A machine of similar design is described in U.S. Pat. No. 5,147,263 to Mueller, issued Sep. 15, 1992. However, rather than increasing the amount of force experienced by the user, the Mueller machine uses a compressor-driven cylinder to aid the user in completing an exercise. Here, a cylinder and an associated compressor are attached via suitable connectors and pulleys to a weight stack which is to be lifted by the user. When needed, the compressor is activated by the user, whereby the piston supplies added force to raise the weight stack.

U.S. Pat. No. 5,558,190 to Chang, issued Sep. 24, 1996, describes a damping device for exercise equipment which includes a two-way piston carried on a transverse piston rod. In this apparatus, the movement of the piston within the cylinder is regulated during both the upstroke and the downstroke by means of valves controlling the passage of air into and out of the cylinder. Similarly, U.S. Pat. No. 4,969,643 to Kroeker et al., issued Nov. 13, 1990, also describes a exercise device wherein resistance is provided by a dampened two-way piston in which fluid flow to and from the chambers on either side of the piston is controlled by adjustable valves. Like Chang's device, the piston in Kroeker et al. is carried on a transverse piston rod.

U.S. Pat. No. 5,622,527 to Watterson et al., issued Apr. 22, 1997, describes a stairstepper device having independently operated foot pedals. Each foot pedal is connected to a corresponding hydraulic piston which provides resistance to downward movement of the foot pedals. Additional upward force on the pedal is provided by biasing springs which move the pedals upward when the user steps off the device. U.S. Pat. No. 4,772,016 to Manion, issued Sep. 20, 1988, describes a similar device designed to exercise the upper body instead of the legs. Here, two arms are joined pivotally at their ends and a hydraulic piston is operationally disposed between the two arms. The piston provides resistance when the two arms are compressed toward one another.

U.S. Pat. No. 5,372,564 to Spirito, issued Dec. 13, 1994, describes a multi-purpose device for exercising the arm, leg, and postural muscles.

SUMMARY OF THE INVENTION

The invention is directed to an exercise device which comprises a cylinder having a first open end and a second end. At the second end of the cylinder is an adjustable means for controlling air intake and exhaust through the second end of the cylinder. A free-floating piston assembly is slidingly disposed within the cylinder. In the preferred embodiment, the piston assembly includes a top piston disc, a bottom piston disc distanced from the top piston disc, and a piston armature connecting the two. One end of a flexible connector, such as a rope or cable, is attached to the piston assembly. Adjustable means for directing the second end of the connector to a user of the invention (e.g., a pulley assembly or other arrangement of friction-reducing surfaces), is provided such that force exerted by the user on the opposing end of the connector is transmitted to the piston assembly, whereby the piston assembly is displaced within the cylinder.

In the preferred embodiment, the adjustable means for directing the connector to a user of the invention comprises a height- and angle-adjustable assembly which can accommodate users of vastly different heights and also allows the invention to be used to exercise different muscle groups. As described in full below, this also enables the invention to be used in conjunction with other exercise devices or to be used on its own.

More specifically, the adjustable means for directing the second end of the connector to a user of the invention comprises a height-adjustable support and a beam movably attached to the support. A pivot pulley is attached to the beam with the pivot pulley disposed such that it's axis of rotation is centered coaxially with the piston assembly. With this arrangement, the beam is infinitely positionable, while the piston pulley simultaneously maintains its collinear relationship with the axis of the piston assembly. A linear motion carrier is translatably attached to the beam, the linear motion carrier being continuously movable across, and releasibly fixable to, any point of the beam. A pulley assembly attached to the linear motion carrier provides further flexibility in configuring the invention to exercise virtually any muscle group and to simulate the mechanics of numerous different exercises, including cross-country skiing and rowing.

A distinct advantage of the present invention is that it provides smooth and independently adjustable resistance to allow a user to exercise using any number of different routines, either alone or in combination with other exercise devices.

Further still, the invention provides adjustable resistance to the contraction of desired muscle groups as the muscles work to displace the piston during upward power stroke and also provides adjustable opposing forces to counteract the force of gravity on the piston during the return stroke. This allows the piston to "float" through its return stroke at a user-selected rate, thus eliminating both positive and negative forces acting on the muscles being exercised during the relaxation phase (return stroke) of the exercise.

This feature of the invention provides several other advantages which are not provided in prior art exercise devices: (1) muscles can be contracted against adjustable resistance at any desired pace, and then relaxed and returned to the start position without being acted upon by positive or negative resistance; (2) the resistance to muscle contraction provided by the invention is smooth and constant throughout the range of motion of the contraction; (3) the invention can be configured in any number of ways to provide a suitable range of motion to exercise any part of the body; (4) the invention can be configured to cool the user with a directed flow of air forced from the cylinder under pressure during the return stroke of the piston; (5) the device can be used in conjunction with any existing aerobic exercise device that works the muscles of the lower body to create a total body exercise; (6) the variable adjustment of both the resistance and rate of the return stroke allows the invention to be used both for rapid, aerobic muscle, endurance-building contractions against low levels of resistance; or slower, anaerobic muscle, strength-building contractions against higher levels of resistance; and (7) for physical therapy applications, the invention allows selected muscles to contract against a selected resistance and then to relax while being acted upon by only the antagonist muscles instead of other external forces.

Another advantage of the invention is that the combination of the adjustable support and the beam with its associated linear motion carrier allows the device to be used in combination with any number of other exercise devices, including treadmills, stationary bicycles, stairsteppers, climbing machines, and the like.

As depicted in the attached figures, the invention is shown being used in conjunction with a treadmill, but is dimensioned and configured to stand alone, and can therefore be used alone. In the preferred configuration, the invention does not require any physical support from any other piece of exercise equipment.

The height-adjustable support 84 and movable beam 82 allows the invention to be collapsed into a much smaller space for storage and moving. In the collapsed position, the invention will easily fit through a standard interior doorway. This collapsibility also allows for more compact packaging for shipping the fully-assembled device and for retail display. When raised to its full height, the support 84 is sufficiently elevated to provide head clearance for virtually any height user. When used at home, the support 84 can be "jacked" against the ceiling to effectively lock the device securely between the floor joists and the ceiling trusses. This makes for an extremely stable and rigid, yet easily removable, installation that does not require any permanent fixtures or leave any scars such as nail-holes and the like when the invention is moved.

In a free-standing configuration, a frame 88 and/or fixed or collapsible legs of any suitable conventional design are used to ensure stability and to prevent movement of the invention during use.

Further aims, objects, and advantages of the present invention will become clear upon a complete reading of the Detailed Description of the Invention and the attached claims.

DETAILED DESCRIPTION OF THE INVENTION

To aid in a complete and unambiguous understanding of the invention, the following definitions are provided. As used herein, the listed terms shall have the meaning provided. All other undefined terms have their standard, accepted meaning:

connector: any type of flexible connector such as rope, cable, wire, chain, and string of any material (metal, natural fiber, synthetic fiber, and the like).

cylinder: A housing of any internal and/or external geometry which defines an internal space adapted for slidingly accommodating a piston within the internal space. As used herein, a "cylinder" is not limited to a housing of circular or oval cross-section.

means for controlling air intake and exhaust: Any means now known or developed in the future for controlling fluid flow between two points, including, but not limited to, valves of all description, such as check, gate, diaphragm, ball-check, control, and knife valves.

piston/piston assembly: (synonymous) an object having external dimensions which roughly complement the internal dimensions of a cylinder. A piston is slidingly disposed within a cylinder and reciprocates therein, either moving against or being moved by fluid pressure.

plenum/plenum chamber: (synonymous) an enclosed space into which air is forced and from which air is removed to create transient air pressure conditions which are either greater than or lesser than atmospheric pressure. Like a "cylinder," a plenum or plenum chamber is a housing of any internal and/or external geometry which defines an internal space.

pulley: includes all types of single or compound pulleys, bearings, block-and-tackle assemblies, bushings, castors, friction-reducing surfaces, journals, pivots, rollers, roller bearing surfaces, and the like, without limitation.

spring: Any type of spring, including air, bias, coil, helical, leaf, and torsional springs.

Figure 1:
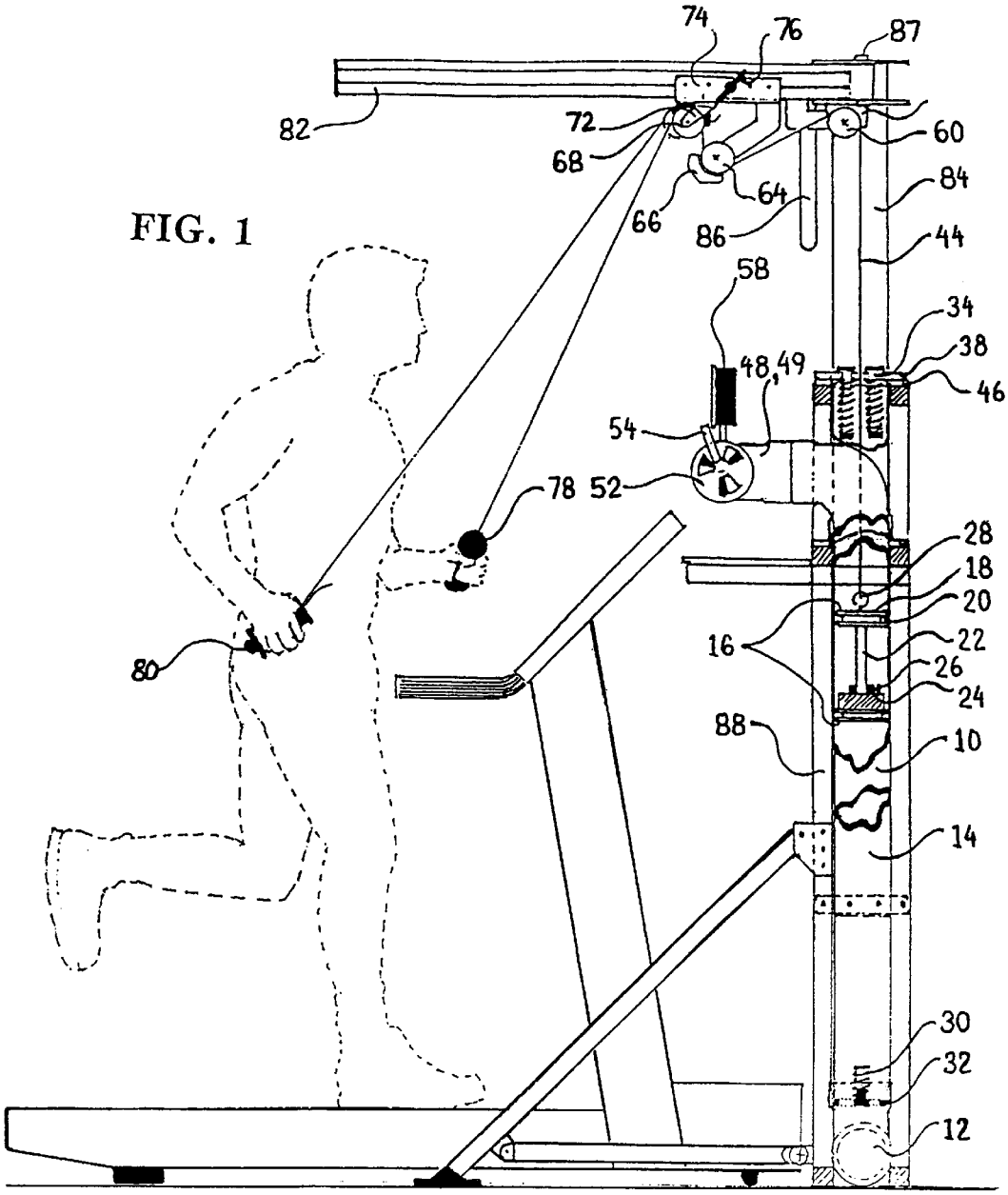
FIG. 1 is a side elevation view, in partial cutaway, of an exercise device according to the present invention. Here, the invention is shown being used in combination with a treadmill.
Figure 2:
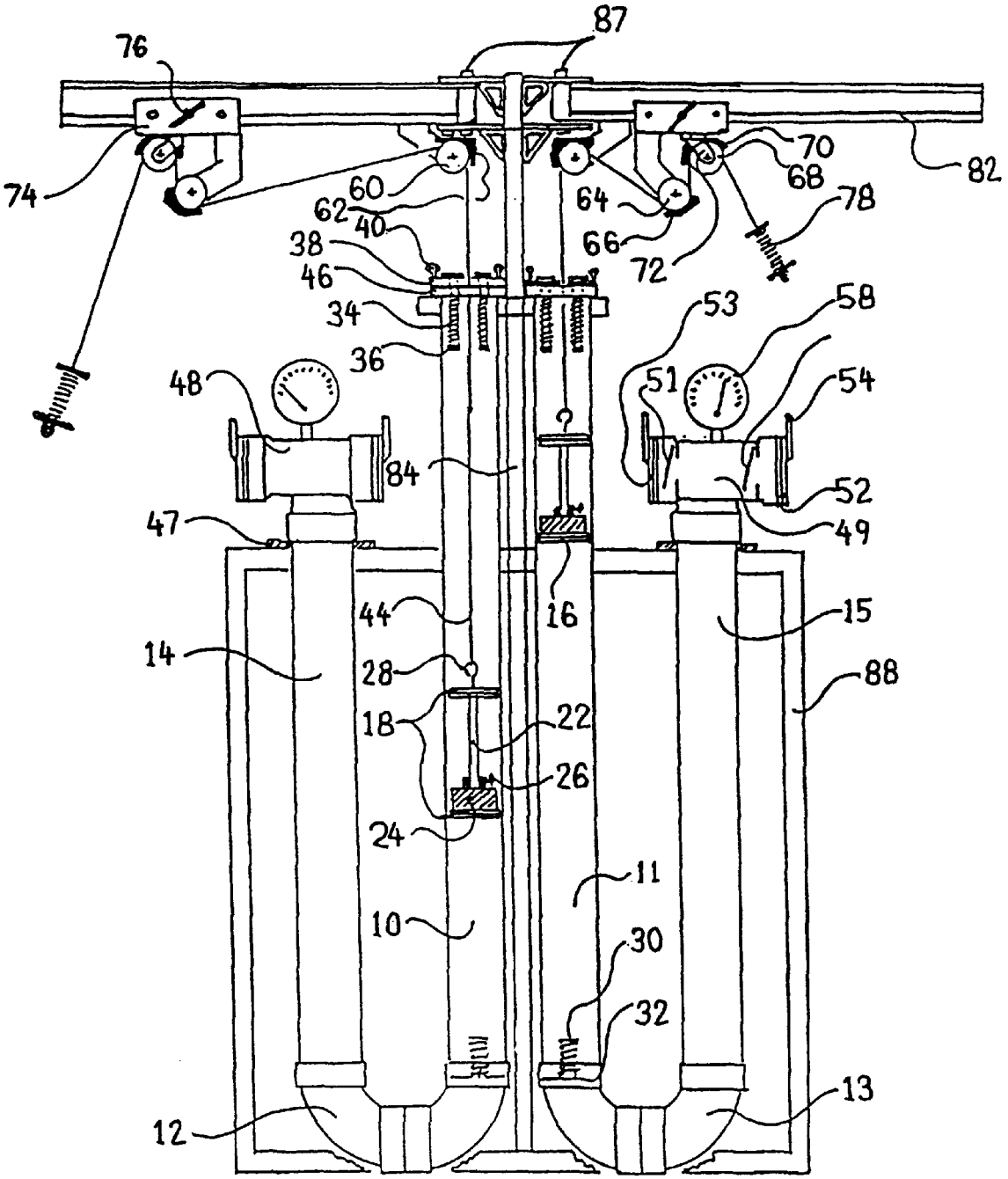
FIG. 2 is a front elevation, cross-section view of the exercise device as shown in FIG. 1.

Singular pronouns and plural pronouns: As shown in FIGS. 1 and 2, the invention is shown as a duplicative pair for independently exercising the right and left arms (or legs). For sake of brevity and clarity, in several instances in the following description singular pronouns have been used. Where appropriate, which is immediately determined by reference to the drawings, singular pronouns also indicate the plural condition and vice-versa.

Referring now to FIGS. 1 and 2, which are a side elevation view and a front elevation view, respectively, of the preferred embodiment of the invention, at the heart of the invention is a pair of independent cylinders 10 and 11. Each cylinder is open to atmosphere at one end and has its own plenum chamber, 14 and 15, which are made integral with their respective cylinders by air channels 12 and 13.

Figure 3:
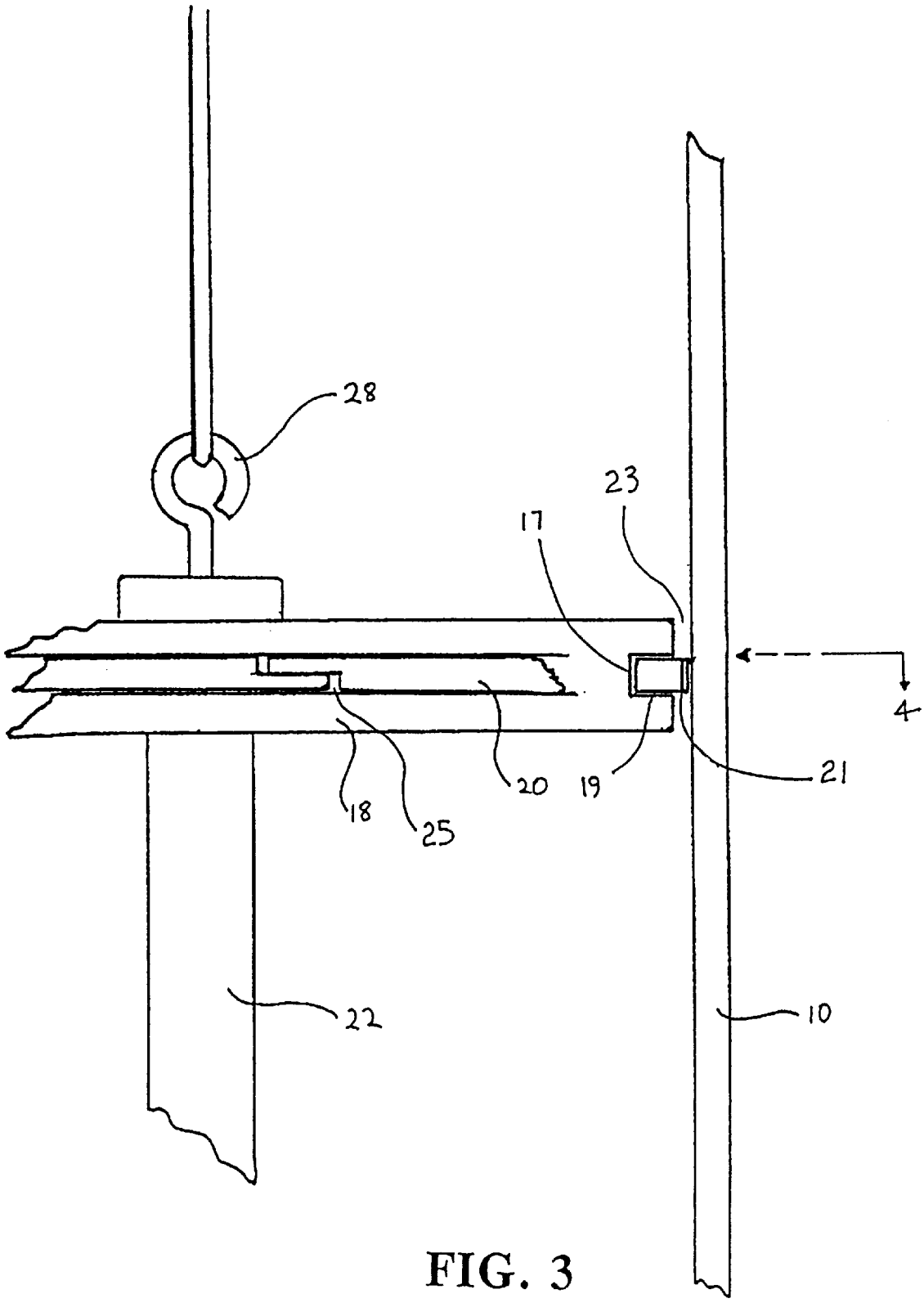
FIG. 3 is a front elevation, cross-section view of the top piston disc 18 depicted in FIGS. 1 and 2.

Slidingly disposed within each cylinder 10 and 11, is a piston assembly 16 having a known mass that is either fixed or user-adjustable. A flexible connector 44 is attached to the top center of each piston assembly 16 by any suitable means. As depicted in FIG. 3, the connector 44 is attached to the piston assembly by eye bolt 28. When acted upon by a user of the invention, it is the connector 44 that lifts the piston assemblies 16 within the cylinders 10 and 11. The force of gravity functions to return the pistons to the bottom of the cylinders.

It is preferred that a spring 30 be mounted on a bridge 32 at the base of each cylinder 10 and 11 to provide a cushioned stop and rest for the pistons 16 when they are at the bottom of the cylinders 10 and 11.

In the preferred embodiment of the invention, the piston assemblies 16 are comprised of two piston discs (a top piston disc and a bottom piston disc) 18 which are attached to each other by a piston armature 22. The top piston disc and bottom piston discs are spaced from one another by the piston armature so as to define a space therebetween. The resultant piston is therefore shaped like a sideways letter "H."

The length of the armature 22 may be fixed or adjustable, as by a telescoping assembly, thereby optionally making the distance between the top and bottom piston discs 18 adjustable. A set of fixed armatures of differing lengths may also be provided to vary the distance between the top and bottom piston discs. This allows a large amount of additional mass, described below, to be loaded onto the piston assembly.

The armature 22 can be made of any suitably rigid material (metal alloys, rigid plastic, etc.) and dimensioned and configured so that the starting weight of the unloaded piston 16 is of any desired weight. Optional additional weights 24 of known mass can be added to the armature 22 and held in place by a releasable fastener 26.

Figure 4:
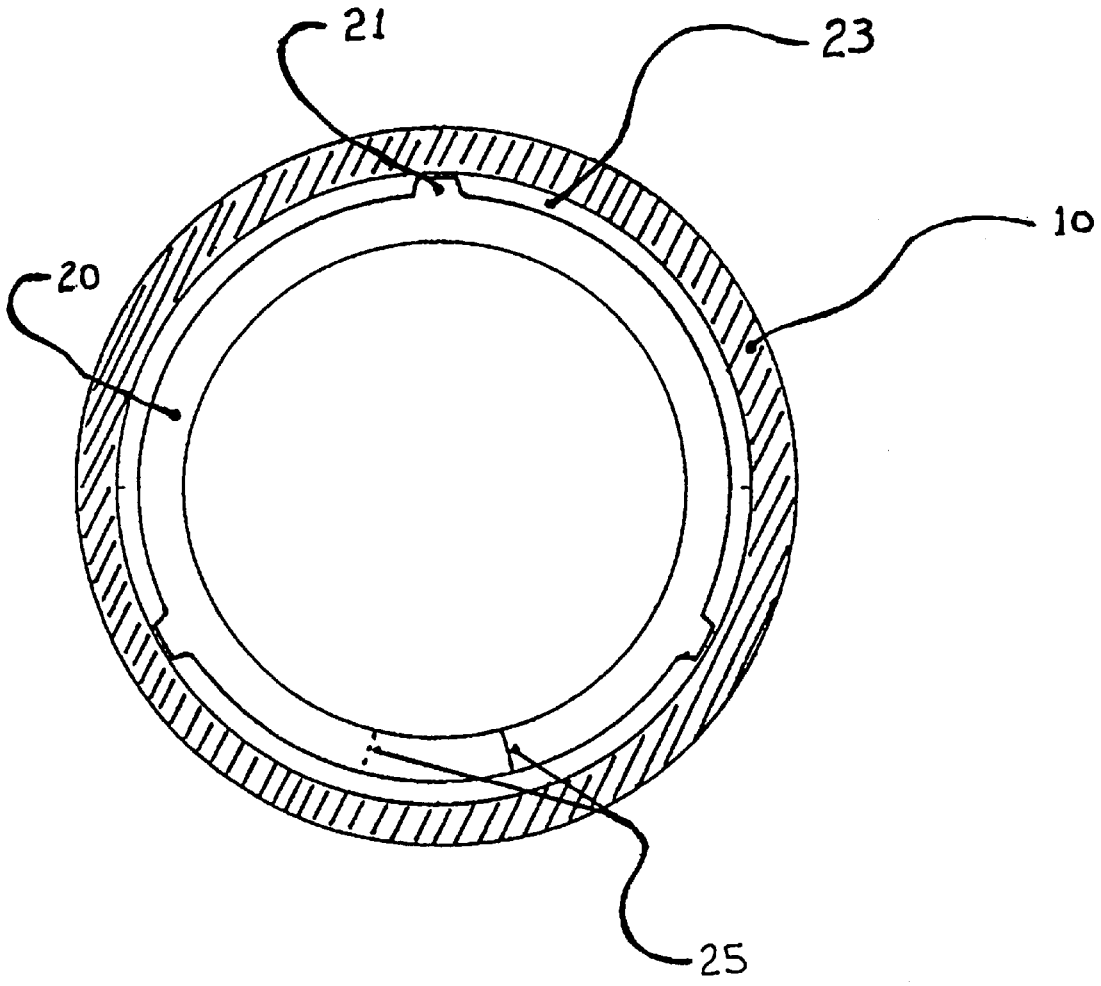
FIG. 4 is a top plan, cross-section view of the piston disc shown in FIG. 3 through line 4.

Referring now to FIGS. 3 and 4, each of the top and bottom piston discs 18 of the piston assembly 16 are slightly smaller in diameter than the cylinder bore so that the piston discs can slide freely within the cylinder. A piston ring 20, made of a friction-reducing material such as "TEFLON," fits within a groove 19 in the edge of the disc 18 which abuts the cylinder wall. The piston ring may be a conventional ring having a circular cross-section. As best shown in FIG. 4, which is a top plan, cross-section view of a piston disc 18 through line 4 of FIG. 3, it is preferred that each piston ring 20 have three or more equally spaced high spots, or contact buttons 21, around its circumference so that as the ring expands outward, only the contact buttons make physical contact the cylinder walls. This serves to limit the area of contact between the piston ring and the inside wall of the cylinder, thereby reducing friction between the piston and the cylinder.

The dimension of the contact buttons' height defines an air gap 23 between the cylinder wall and the piston ring 20 around the entire circumference of the piston ring between the contact buttons. Compared to the amount of air displaced by the piston itself, the amount of air passing through the gap is quite small. A split 25 in the piston ring 20 with an overlap allows the piston ring to expand and contract to compensate for small variations in the diameter of the cylinder bore throughout its length, while maintaining an air gap of substantially the same width.

As the piston, which is free-floating, rises and falls within the cylinder, a small amount of air passes around the piston through the air gap 23. This small flow of air cushions the piston and centers it within the bore of the cylinder so that the piston glides smoothly within the cylinder.

The piston discs themselves may be a formed from a single piece of stock into which a suitable annular groove is disposed. In this case, a split-ring piston ring is disposed within the groove. Or, the piston discs may be made from two or more pieces (see FIGS. 6A, 6B, and 7) which cooperate to define an annular groove, in which case the piston rings may be continuous.

Figure 5:
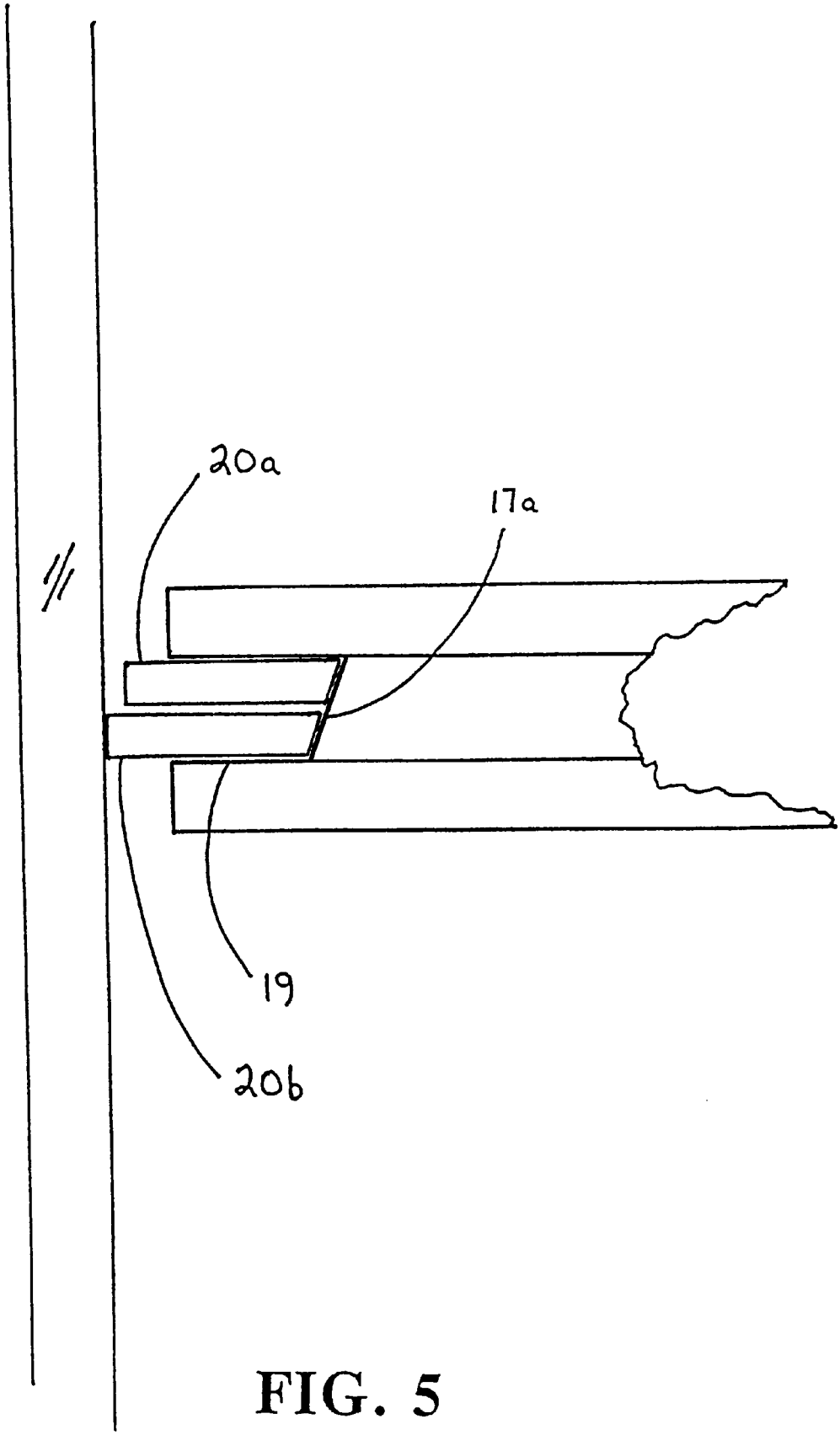
FIG. 5 is a front elevation, cross-section view of a second embodiment of a piston disc (either top, bottom, or both) which can be used in the present invention.

Referring specifically to FIGS. 3 and 5, the annular groove 19 where the piston ring is seated can either have a perpendicularly disposed floor, as depicted at 17 of FIG. 3, or a floor 17*a* which has one acute angle and one obtuse angle, relative to the walls of the annular groove. The advantage of a sloping floor of the annular groove is that during the power stroke, when the piston is moving upward in FIG. 5, the piston ring will deform slightly within the groove so that it is forced outward by the slope of the floor 17*a* to make more substantial contact with the cylinder wall, as shown in 20*b*. This additional contact substantially eliminates any air passage around the cylinder, thereby creating a more complete vacuum underneath the piston, and hence greater resistance, during the power stroke. When the piston is on its return stroke (moving downward in FIG. 5), the piston ring is moves toward position 20*a* and retracts slightly into the groove, thereby allowing the piston to fall with a decreased amount of resistance from the contact between the piston ring and the cylinder wall.

Figure 6A:
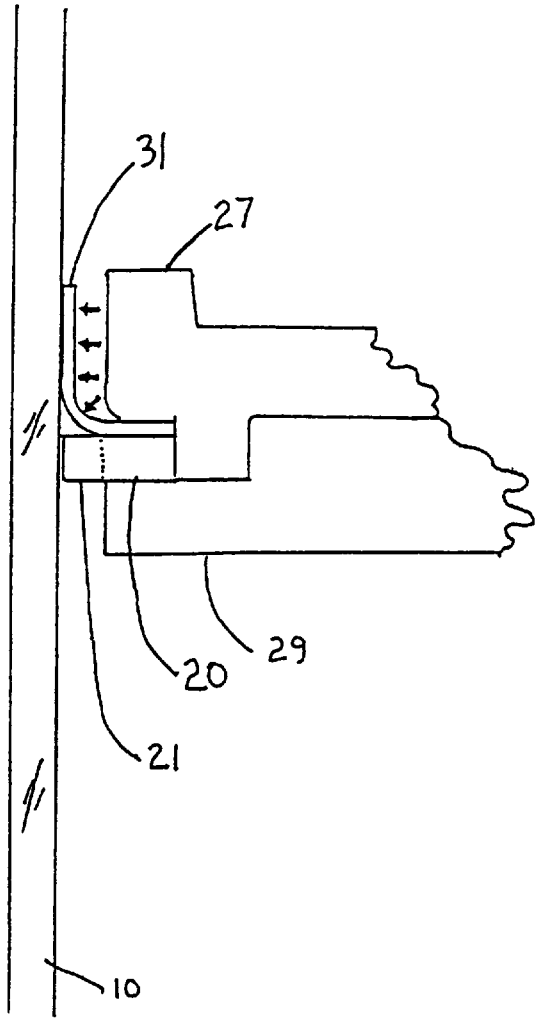
FIG. 6A is a front elevation, cross-section view of a third embodiment of a piston disc (either top, bottom, or both) which can be used in the invention. The piston disc is depicted during the power stroke.
Figure 6B:
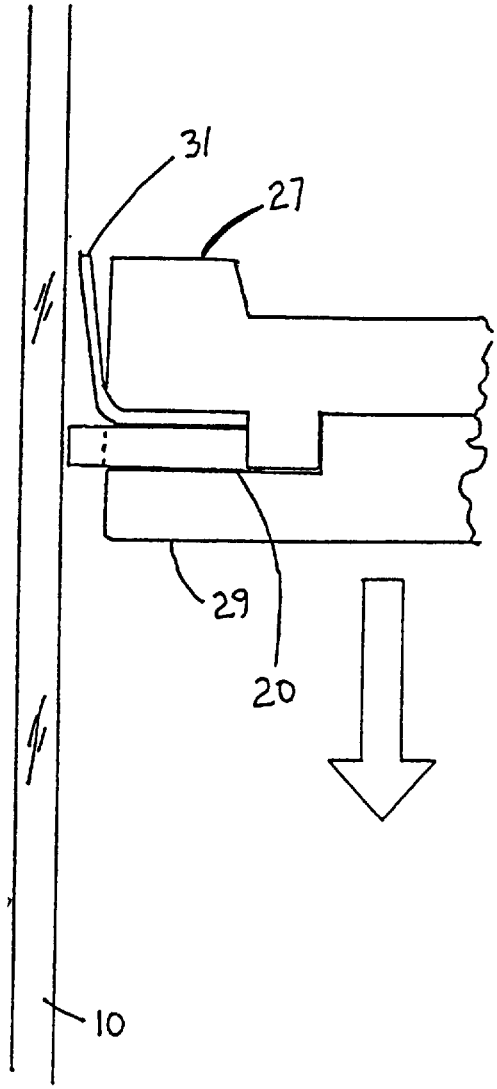
FIG. 6B is a front elevation, cross-section view of the piston disc depicted in FIG. 6A during the return stroke.

FIGS. 6A and 6B show another piston assembly which can be utilized with the present invention. Here, the piston disc is fabricated from a top plate 27 and a bottom plate 29 which are fastened to one another by suitable means, such as machine screws (see FIG. 7). The top and bottom plates cooperate to define an annular groove in the piston disc, as described above. Because the two plates can be separated, the piston rings 20 and 31 need not have a split, and can be continuous rings.

FIG. 6A shows a piston ring assembly wherein a piston ring 20, as described above, is disposed below a cup-shaped piston ring 31. The piston ring 31 has a flexible outer peripheral lip which contacts the cylinder only during the power stroke, as shown in FIG. 6A. As the piston assembly rises in the cylinder during the power stroke, air pressure on top of the piston forces the outer peripheral lip of the piston ring 31 to come in contact against the wall of the cylinder 10. This forms a tight, slidable seal between the piston assembly and the cylinder wall.

Figure 8:
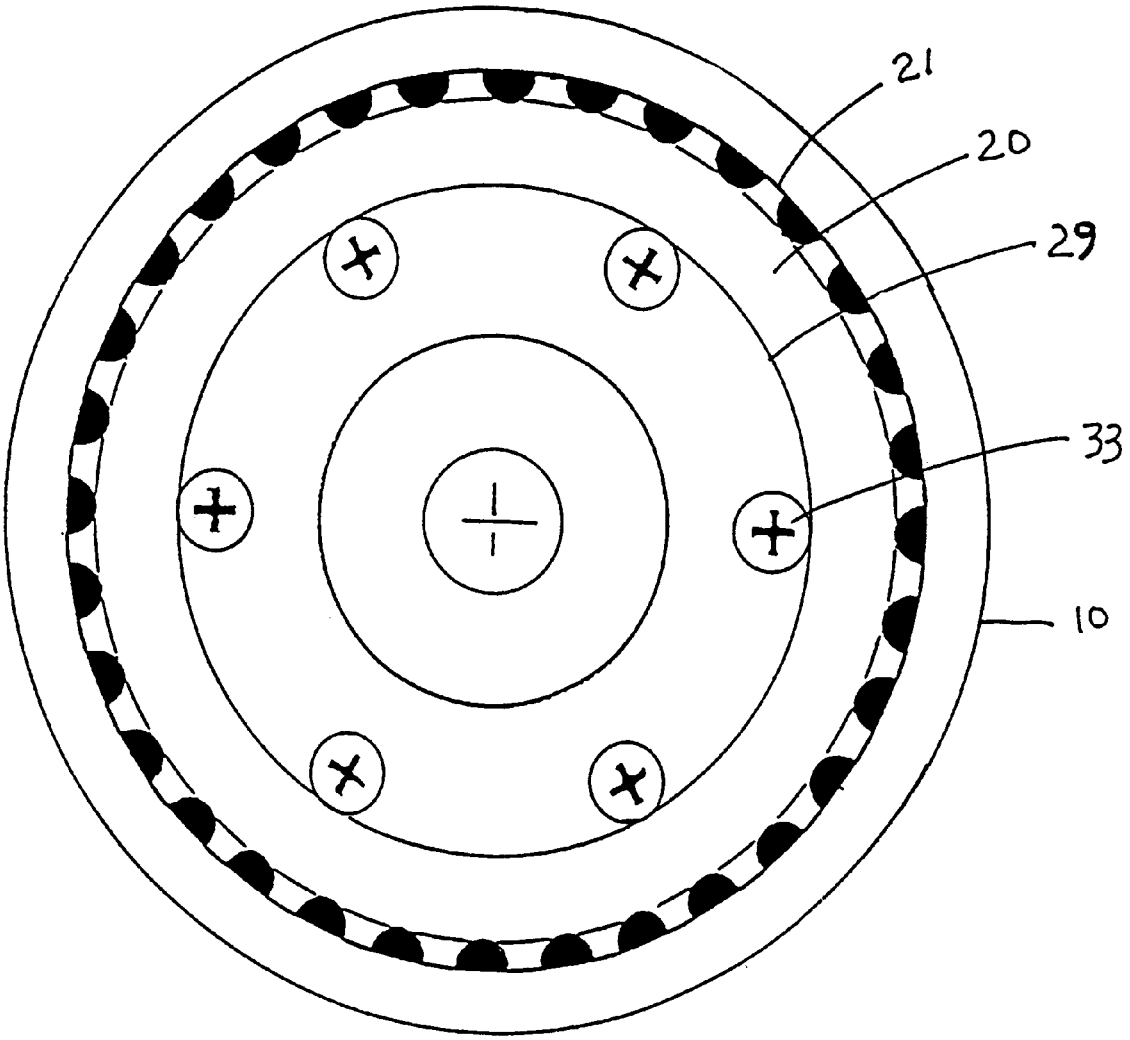
FIG. 8 is a top elevation, cross-section view taken through line 8—8 of FIG. 7.

FIG. 6A depicts the return stroke of the piston. Here, air pressure from below the piston assembly, in conjunction with the cupped shape of the piston ring, forces the lip of the piston ring 31 toward the piston disc. This allows the piston to free fall through the cylinder without increased friction between the piston ring 31 and the cylinder wall. The piston ring 31 is supported by the piston ring 20 which has numerous contact buttons 21 as shown in FIG. 8. The contact buttons 21 prevent the peripheral lip of the piston ring 31 from inverting during an overly forceful power stroke.

Figure 7:
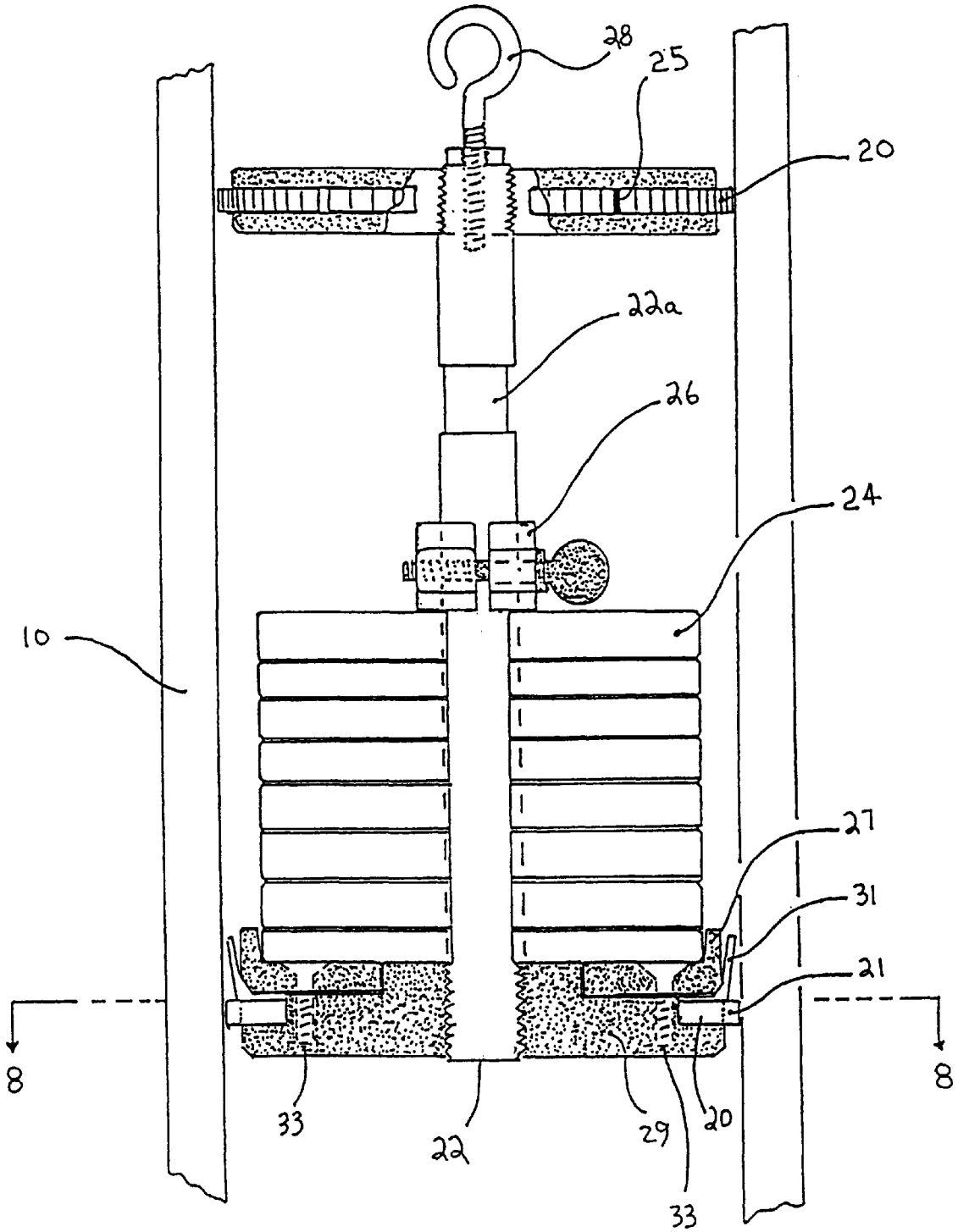
FIG. 7 is a front elevation, cross-section view of a piston assembly with added weight disposed within a cylinder according to the present invention.

FIG. 7 depicts a front elevation of a piston assembly having a bottom piston disc as depicted in FIGS. 6A and 6B, and a top piston disc as depicted in FIG. 3. Split 25 is shown in piston ring 20 of the top piston disc. As shown in FIG. 7, the piston assembly includes optional added weights 24. As shown here, the weights are C-shaped and have a central bore passing therethrough and a slightly smaller notch forming the open end of the "C." (FIG. 7 is the view into the open end of the "C"). The weights are loaded onto the piston assembly by removing the piston from the cylinder and inserting the open end of each C-shaped weight onto the shoulder 22*a* of piston armature 22 and sliding the weight down into position over the bottom piston disc. The external dimensions of the shoulder 22*a* and the internal dimensions of the open end of the C-shaped weights are of complementary dimensions. The external dimensions of the remainder of the armature 20 are slightly larger, as are the internal dimensions of the bore passing through the center of each weight so that once lowered into position, the weights are securely attached to the armature.

FIG. 8 depicts a top plan, cross-section view through the line 8—8 of FIG. 7. Screws 33 for attaching the top plate 27 to the bottom plate 29 can be seen. Also shown are a large plurality of contact buttons 21 in piston ring 20.

Referring back now to FIGS. 1, 2, and 3, attached to the top of the piston 16 is a flexible connector 44 that rises out of the center of the open cylinder to a pivot pulley 60 mounted on a beam 82 which is movably mounted to a height-adjustable support 84 by attachment 87. The pivot pulley is protected by an optional pulley guard 62.

The pivot pulley 60 is mounted to the bottom of the movable beam 82 so that the axis of the connector 44, and therefore the center of the cylinder 10 or 11, is the axis of the pivot point of the beam 82. The beam 82 is pivotable horizontally through an angle of at least 180 degrees and is locked in position by a brake 86 (see FIG. 2). Because of the axis alignment of the cylinders 10 or 11, connectors 44, pulleys 60 and beam attachment 87, the connector 44 stays centered over the cylinder throughout the beams' arc of rotation.

Slidingly attached to the beam 82 is a linear motion carrier 74 that can be positioned and releasibly fixed at any point along the beam's length by a brake 76. Suspended on the linear motion carrier 74 is at least one pulley and preferably two cooperating pulleys 64 and 68.

In the preferred configuration, the pulley 64 has a fixed axis and only rotates within that fixed axis. The same is also preferred of the pivot pulley 60, in which case the pivot pulley and pulley 64 rotate in same axis. As depicted in FIGS. 1 and 2, pulley 64 is mounted below a third pulley 68 which is mounted in a castor 72 so that it has a variable rotational axis. The function of the pulley 64 is to convert the direction of travel of the connector 44 from roughly horizontal to vertical as it approaches pulley 68, so that pulley 68 can be mounted on castors for full freedom of motion for the user of the invention.

This preferred arrangement of pulleys allows the angle at which force is applied to the flexible connectors 44 to be essentially infinitely adjustable. The connector 44 translates around the pivot pulley and the pulleys attached to the linear motion carrier in an "S" pattern. Each connector passes out of the cylinders 10 and 11, over the pivot pulley 60, through the pulley 64 on the linear motion carrier, and then over the top of the castoring pulley 68, where it terminates at a hand grip 78. The hand grip is dimensioned and configured to be gripped comfortably in a user's hand.

Using this arrangement, in whatever direction the user pulls on the hand grips, the castor 68 automatically follows the movement to keep pulley 68 operationally linked to pulley 64 and the pivot pulley 60. Optionally, the various pulleys include guards 62, 66, and 70 to prevent the connector 44 from jumping off the pulley.

While the above-described pulley arrangement is preferred, a simplified machine, which is easier and cheaper to manufacture, can be had by simply omitting the linear motion carrier and its associated pulleys entirely. In this arrangement, the connectors 44 pass through the pivot pulleys 60 and pass directly into the user's hands. This arrangement produces a range of motion which is very effective to simulate the upper body motion of cross-country skiing and is especially beneficial when used in combination with a treadmill, stationary bicycle, or other lower-body exercise machines.

Within each hand grip 78 there is a means 80 for adjusting the length of the connector 44 to fit users of differing sizes and to accommodate the different exercises being performed by a user. As shown in FIG. 1, the means is an adjustable button 80 which fits within a bore passing through the hand grip 78. The button frictionally engages the connector 44 at any user-selected point along the length of the connector.

Figure 9:
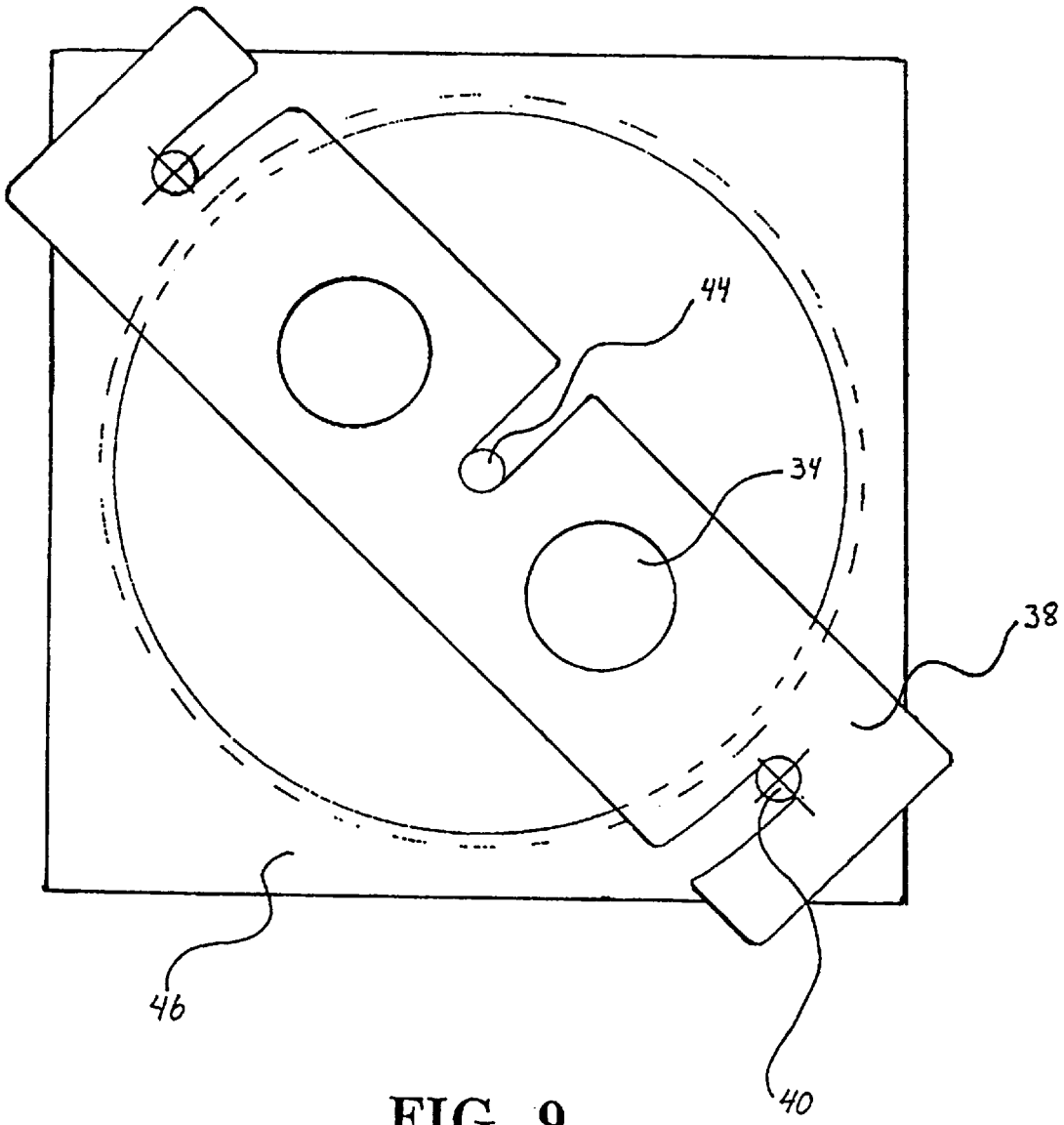
FIG. 9 is a top plan view of the cylinder head cap 46.
Figure 10:
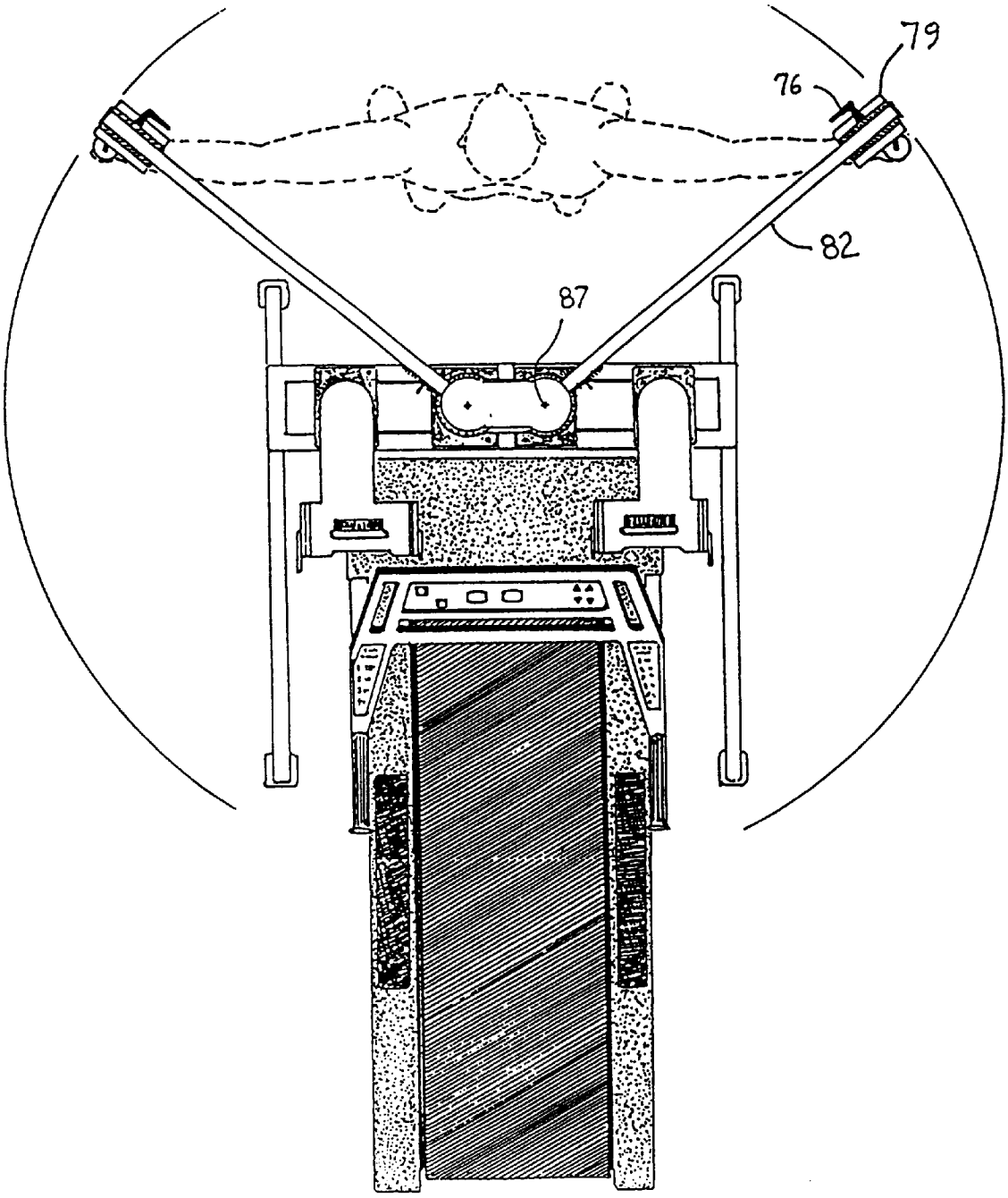
FIG. 10 is a top plan view of an exercise device according to the present invention. This figure depicts how the invention can be used independently of other exercise machines without repositioning the entire device.

Referring now to FIG. 9, which is a top plan view of one of the cylinders at its first open end, at the top of each cylinder 10 and 11 is a removable cylinder head bridge 38. The bridge releasibly attaches to a cylinder head cap 46 by any conventional means, such as two wing bolts 40 for easy removal. The bridge 32 has a slot in the center through which passes the connector 44. To either side of center of the bridge is a guide hole to which a spring-loaded plunger rod 34 is attached (see FIG. 2). As the piston 16 reaches the top of the cylinder, the upper piston disc 18 contacts the tips 36 of the two spring-loaded plunger rods 34. The rods 34 rise out of the bridge 38 while the springs which surround the rods compress. When the springs are completely compressed, the piston 16 cannot travel upward any farther.

The bridge and spring-loaded plunger rods serve three distinct functions. The first, and most obvious function is to keep the pistons 16 from exiting the cylinders 10 and 11 during use. The second function is to provide a cushioned stop at the end of the user's stroke that is not abrupt, but smoothly decelerating until the piston changes direction. In practice, when pulling on the connector 44 until the piston reaches the top of the cylinder, the user experiences an increased force that gradually becomes immovable. The plunger rod extending from the top of the cylinder also provides a visual indication that the top of the piston stroke has been reached; a user can see the rods 34 rise out of the bridge 38. The third function is possibly the most important: the spring-loaded plunger rods counter the upward inertia of the piston 16. This is important from a user-comfort and utility point of view because the invention is designed, in part, for rapid, repetitive aerobic motions using relatively light weight pistons. All other conventional weight-lifting machines are designed only for a far slower and controlled motion exercise, lifting much heavier loads. In contrast, when using the present invention, the piston 16 can be rising very rapidly near the top of the cylinders 10 and 11. Instead of abruptly stopping his power stroke and introducing slack in the connector as the piston continues to rise due to its inertia (which slack will then abruptly jerk the user's arm when the piston begins its return stroke), the bridge and spring arrangement smoothly absorbs the inertia of the piston at the top of its stroke and changes its direction to begin the return stroke.

A critical element of the invention is adjustable means for independently controlling air intake and exhaust through the second end of the cylinders 10 and 11 or plenum chambers 14 and 15. In the preferred embodiment depicted in FIGS. 1 and 2, these means are accomplished as follows: At the top of each plenum chamber 14 and 15 is a valve head 48. Each valve head contains a reverse-mated pair of check valves 50 and 51 and throttle valves 52 and 53 for independently throttling the rate of air intake and exhaust, respectively, through the plenum chambers and hence the second end of the cylinders.

The intake throttle valve 52, which is identical to the exhaust throttle valve 53, is best shown in FIG. 1. Each throttle valve includes a handle 54 attached to a rotatable plate having a number of apertures passing therethrough. By rotating the plate with the handle 54 the apertures are either placed in registration with a corresponding set of apertures within the throttle valve or a corresponding set of closures. Consequently, by rotating the plate, the amount of air passing through the valve can be continuously adjusted from an unhindered passage of air through the valve to a complete closure, with absolutely no air passing through the throttle valve.

If the cylinders 10 and 11 were open and unrestricted at both their ends, the resistance provided by pulling the connector 44 is no more than lifting the mass of the piston 16, that is, the resistance provided is no more than the actual weight of the piston. In the same fashion, on its return stroke, the force exerted on a user by the piston 16 falling through the cylinder is the rate and acceleration of gravity.

However, by adjusting the intake throttle valve 52 appropriately, the force required to raise the piston can be increased by creating a partial or complete vacuum within the plenum chamber (underneath the piston). The amount of force required to raise the piston is user-adjustable by simply turning the intake throttle valve until the desired resistance is reached. Likewise, the speed and force of the return stroke can be decreased by adjusting the exhaust throttle valve 53, thereby creating increased pressure below the piston as it falls and cushioning its descent.

This allows a user of the invention to faithfully replicate the upper body mechanics of cross-country skiing. Weight, work, and force are experienced in one direction (the power stroke) and near zero force or resistance is experienced on the return stroke. This is of great physical benefit to the user because the upper body muscle groups are given a moment of rest between each power stroke. In short, because the air below the piston assemblies 16 is channeled into a plenum chambers 14 and 15, the resistance experienced by the user can be independently adjusted. In fact, the resistance experience by either arm of the user can be independently adjusted and the resistance provided on the power stroke versus return stroke can also be independently adjusted by regulating the intake of air on the power stroke and regulating the escape of air on the return stroke by the use of the valves 50, 51, 52, and 53 in the plenum valve head 48.

One notable benefit of the present invention is that it can be configured so that the exhaust manifold of the valve head 48 can be situated so as to exhaust the air from the plenum chambers in the direction of the user. This provides a constant breeze which not only cools the user during a workout, but further adds to the simulation of cross-country skiing by providing an artificial head wind.

In operation, the invention functions as follows (for one power and return stroke in cylinder 11 of FIG. 2): At the beginning of a power stroke the piston assembly 16 is at or near the bottom of the cylinder 10 and the user's arm is raised or extended (depending upon the positioning of the support 84, beam 82, and linear motion carrier 74. As the user pulls on the connector 44, the piston assembly 16 starts to rise within the cylinder. At that instant, the volume displaced by the movement of the piston 16 causes a pressure drop within the plenum chamber 15, the effect of which is transmitted to the piston via air channel 13. This pressure drop causes the exhaust check-valve 51 to close, isolating the exhaust throttle valve 53 from being a source of incoming air. At the very same instant, the intake check-valve 50 opens and air enters past the intake throttle 52 into the plenum chamber 15, to match the volume displaced by the upward-moving piston.

If the throttle valve 52 is opened to allow air to enter at the same rate that it is displaced by the rising piston 16, no pressure drop is created within the plenum chamber and the piston 16 rises unencumbered and the user experiences a resistance which is equal to the actual weight of the piston 16.

But, if the intake throttle valve 52 is progressively shut, there becomes a greater and greater restriction on the flow of air into the plenum chamber 15, and a partial vacuum is created at the bottom of the piston. This adds to the amount of force (in addition to the actual weight of the piston) which is required to lift the piston to the top of the cylinder 11.

This is a major advantage of the invention. The force required to raise a one kilogram piston, for instance, can be increased in weight simply by turning the knob of the intake throttle valve 52 (which can be positioned at a point easily reached by the user). By choking off the rate of air entering the plenum chambers during the power stroke, the force required to raise the piston to the top of the cylinder can be increased in a continuous and dramatic fashion. For instance, using a piston approximately 10 cm in diameter disposed in a mated cylinder approximately 2 meters in length, when the intake throttle valve 52 is closed completely, the force required to raise the piston 16 from the bottom to the top of the 2 meter cylinder approaches 200 pounds.

Adjusting the rate of air passage through the intake throttle valves can be done while the user continues exercising, without having to stop and to change weights. The partial vacuum exerted on the bottom of the piston also helps counter the upward inertia of the piston when it reaches the end of the power stroke.

As the piston 16 reaches the top of the power stroke and begins the return stroke, any vacuum below the piston is generally quickly equalized for in most cases the intake throttle valve 52 is open at least slightly. At the top of its power stroke, the piston encounters the spring-loaded plunger rod 34 which absorbs the upward inertia of the piston and forces it to come to a stop and begin its downward return stroke. As the piston travels downward, the countervailing force of the spring-loaded plunger rod and the acceleration of gravity act upon the piston. At this point, the intake check valve 50 closes to isolate the intake throttle valve 52 so that it cannot serve as an exhaust path for air now being displaced through the plenum chamber 15 by the falling piston. Now, the other check valve 51 opens and air exhausted from the plenum chamber passes through throttle valve 53. The only way out of the plenum chamber for the air being displaced by the downward moving piston 16 is now through check valve 51 and throttle valve 53. This is what provides the physics needed to duplicate the return stroke of cross-country skiing. By trapping air below the piston 16, the piston "parachutes" or floats downward at a rate which is user selectable by setting the rate of exhaust through the exhaust throttle valve 53.

By setting the intake throttle valve 52 and the exhaust throttle valve 53 appropriately, virtually any resistance during the power stroke and rate of descent during the return stroke can be selected by the user.

In testing of the invention by several users, it has been found to be physically impossible to move the arms faster or to change directions more quickly than the machine can follow.

Several other advantages of the invention are immediately realized. For example, by crossing the connectors 44, the piston disposed in the left cylinder 10 can be lifted with the right arm and vice-versa. When this is done, the connectors 44 cross each other at a point in front of the user. By positioning the beams 82 different distances apart and adjusting the positioning of the linear motion carriers 74, an infinite number of tangent points become possible. As the crossing connectors 44 form an "X" in front of the user, the center of the "X" is the effective tangent point from which each connector is being acted upon in turn. Consequently, a wide range of motions is possible, including many ranges of motion which cannot be simulated using ski poles.

The vacuum or negative pressure in the plenum chambers 14 and 15 can be used to calculate or directly indicate the resistance provided by the movement of the piston during the power stoke. A manometer 58 is operationally connected to each plenum to indicate the vacuum within each plenum chamber. The manometer can be calibrated in any suitable unit of measure, such as inches of water (or mercury), pounds per square, pounds, kilograms, Pascals, and the like. The manometer can be of any suitable design now known or developed in the future, including electronic pressure detection.

The working components listed and described above are generally mounted in or attached to a suitably rigid frame 88 that provides structural support and alignment for the components. The frame can be fabricated from any number of suitable and well known materials including wood, metal, and plastics. The configuration of the cylinders, plenums, valves, etc. is also ultimately in the hands of the manufacturer, taking into account such considerations as size, cost, and target purchaser, and the like.

It is understood that the invention is not confined to the particular construction and arrangement of parts illustrated and described above, but embraces all modified forms thereof as come within the scope of the following claims.

What is claimed is:

1. An exercise device comprising:

a cylinder having a first open end and a second end;

means for controlling air intake and exhaust through the second end of the cylinder;

a free-floating piston assembly slidingly disposed within the cylinder;

a flexible connector having a first end and a second end, the first end of the connector attached to the piston assembly; and means for directing the second end of the connector to a user of the device such that force exerted by the user on the second end of the connector is transmitted to the piston assembly, whereby the piston assembly is displaced within the cylinder, the means for directing comprising a support, a beam pivotally attached to the support, a pivot pulley attached to the beam and disposed coaxially with the piston assembly and a pulley assembly attached to a linear motion carrier, the linear motion carrier being releasably fixable and translatable along the beam, wherein the second end of the connector passes through the pivot pulley and the pulley assembly attached to the linear motion carrier.

2. The exercise device according to claim 1, further comprising a plenum chamber in fluid communication with the cylinder, the plenum chamber disposed between the second end of the cylinder and the means for controlling air intake and exhaust through the second end of the cylinder.

3. The exercise device according to claim 1, wherein the piston assembly further comprises a top piston disc, a bottom piston disc distanced from the top piston disc, and a piston armature connecting the top and bottom piston discs, and wherein the first end of the connector is attached to the piston armature at a point proximate to the top piston disc.

4. The exercise device according to claim 3, wherein each of the top and bottom piston discs includes a groove disposed along a peripheral edge thereof which abuts the cylinder, and further comprising at least one piston ring disposed within each groove.

5. The exercise device according to claim 3, wherein the piston ring, comprises a flexible, cup-shaped ring having an outer peripheral lip contactable the cylinder.

6. The exercise device according to claim 3, wherein the top and bottom piston discs define a space therebetween, and wherein the device further comprises a weight of user-selectable mass releasibly fixed within the space between the top and bottom piston discs.

7. The exercise device according to claim 1, wherein the means for controlling air intake and exhaust through the second end of the cylinder is a valve.

8. The exercise device according to claim 7, wherein the valve is a two-way check valve wherein air intake into the second end of the cylinder can be regulated independently of air exhaust from the second end of the cylinder.

9. The exercise device according to claim 1, further comprising a bridge disposed proximate to the first open end of the cylinder and at least one spring attached to the bridge such that the spring bears upon the piston assembly as the piston assembly approaches the open end of the cylinder.

10. The exercise device according to claim 1, further comprising a bridge disposed distal to the first open end of the cylinder and at least one spring attached to the bridge such that the spring bears upon the piston assembly as the piston assembly travels away from the open end of the cylinder.

11. The exercise device according to claim 1, wherein the support is adjustable in height.

12. An exercise device comprising:

a cylinder having a first open end and a second end;

a plenum chamber having a first end in sealed fluid communication with the second end of the cylinder, and a second end;

means for controlling air intake and exhaust through the plenum chamber, the means disposed proximate to the second end of the plenum chamber;

a free-floating piston assembly slidingly disposed within the cylinder;

a flexible connector having a first end and a second end, the first end of the connector attached to the piston assembly; and means for directing the second end of the connector to a user of the device such that force exerted by the user on the second end of the connector is transmitted to the piston assembly, whereby the piston assembly is displaced within the cylinder, the means for directing comprising a support, a beam pivotally attached to the support, and a pivot pulley attached to the beam and disposed coaxially with the piston assembly and a pulley assembly attached to a linear motion carrier, the linear motion carrier being releasably fixable at any point along the beam, wherein the second end of the connector passes through the pivot pulley and the pulley assembly attached to the linear motion carrier.

13. The exercise device according to claim 12, wherein the means for controlling air intake and exhaust through the plenum chamber is a pair of unidirectional check valves of opposite direction and a pair of corresponding throttle valves wherein air intake into the plenum chamber can be regulated independently of air exhaust from the plenum chamber.

14. The exercise device according to claim 12, wherein the support is adjustable in height.

15. The exercise device according to claim 12, wherein the piston assembly further comprises a top piston disc, a bottom piston disc distanced from the top piston disc, and a piston armature connecting the top and bottom piston discs, and wherein the first end of the connector is attached to the piston armature at a point proximate to the top piston disc.

16. The exercise device according to claim 15, wherein each of the top and bottom piston discs includes a groove disposed along a peripheral edge thereof which abuts the cylinder, and further comprising at least one piston ring disposed within the groove.

17. The exercise device according to claim 16, wherein the at least one piston ring comprises a flexible, cup-shaped ring having an outer peripheral lip which contacts the cylinder.

18. The exercise device according to claim 15, wherein the top and bottom piston discs define a space therebetween, and wherein the device further comprises a weight of user-selectable mass releasibly fixed within the space between the top and bottom piston discs.

19. The exercise device according to claim 11, further comprising a first bridge and a second bridge, the first bridge disposed across the first open end of the cylinder and at least one first spring attached to the first bridge such that the first spring bears upon the piston assembly as it approaches the open end of the cylinder, the second bridge disposed distal to the first open end of the cylinder and at least one second spring attached to the second bridge such that the second spring bears upon the piston assembly as the piston assembly travels away from the open end of the cylinder.

20. An exercise device comprising:

a cylinder having a first open end and a second end;

a plenum chamber having a first end in sealed fluid communication with the second end of the cylinder, and a second end;

means for controlling air intake and exhaust through the plenum chamber, the means disposed proximate to the second end of the plenum chamber and comprising a pair of unidirectional check valves of opposite direction and a pair of corresponding throttle valves wherein air intake into the plenum chamber can be regulated independently of air exhaust from the plenum chamber;

a free-floating piston assembly slidingly disposed within the cylinder, the piston assembly comprising a top piston disc, a bottom piston disc distanced from the top piston disc, and a piston armature connecting the top and bottom piston discs;

a flexible connector having a first end and a second end, the first end of the connector attached to the piston assembly; and means for directing the second end of the connector to a user of the device such that force exerted by the user on the second end of the connector is transmitted to the piston assembly, whereby the piston assembly is displaced within the cylinder, the means comprising a height-adjustable support;

a beam movably attached to the support;

a pivot pulley attached to the beam, the pivot pulley disposed such that it is centered coaxially with the piston assembly;

a linear motion carrier translatably attached to the beam, the linear motion carrier continuously movable across, and releasibly fixable to, any point of the beam; and a pulley assembly attached to the linear motion carrier, the pulley assembly comprising a first pulley of fixed axis and a second, castoring pulley, wherein the second end of the connector passes through the pivot pulley and the pulley assembly attached to the linear motion carrier.

* * * * *